US008807876B2

(12) United States Patent
Affi

(10) Patent No.: US 8,807,876 B2
(45) Date of Patent: Aug. 19, 2014

(54) METHOD AND DEVICE FOR SUPPORTING LIGHTLY LOADED STRUCTURES AND PAVEMENTS ON HIGHLY EXPANSIVE SOILS

(76) Inventor: Liiban Affi, Irvine, CA (US)

( * ) Notice: Subject to any disclaimer, the term of this patent is extended or adjusted under 35 U.S.C. 154(b) by 0 days.

(21) Appl. No.: 12/875,616

(22) Filed: Sep. 3, 2010

(65) Prior Publication Data

US 2012/0057941 A1 Mar. 8, 2012

(51) Int. Cl.

*E02D 31/00* (2006.01)
*E02D 31/12* (2006.01)
*E02D 27/32* (2006.01)

(52) U.S. Cl.

CPC ..... *E02D 31/12* (2013.01); *E02D 27/32* (2013.01)
USPC ..... 405/229; 405/258.1; 405/302.4; 404/28

(58) Field of Classification Search

USPC ..... 405/229, 258.1, 272, 302.4; 52/169.1–169.14; 404/27, 28, 31
See application file for complete search history.

(56) References Cited

U.S. PATENT DOCUMENTS 5,474,400 A * 12/1995 Kliefoth et al. ..... 405/229
5,823,716 A * 10/1998 Dray et al. ..... 405/258.1
5,934,036 A * 8/1999 Gallagher, Jr. ..... 52/323

* cited by examiner

*Primary Examiner* — Sean Andrish
(74) *Attorney, Agent, or Firm* — John R. Ross; John R. Ross, III

(57) ABSTRACT

A device and method for supporting lightly loaded structures on highly expansive soils. A plurality of domes is positioned between the lightly loaded structure and the soil. Each of the domes has a convex side and a concave side. The convex side faces upward against the lightly loaded structure and the concave side faces downward against the soil. The concave side provides a void area for expansion of soil. Each dome also has two soil contact ends. The soil contact ends provide a small contact area with the soil to increase the pressure exerted by the lightly loaded structure at the soil contact area to overcome the swelling effects of expanding soil. In a preferred embodiment each dome is fabricated from PVC pipe.

5 Claims, 15 Drawing Sheets

Foundation Analysis English Units

Soils Data

| | | |
|---|---|---|
| Max. Soil/Bedrock Swelling Pressure | 10000 | psf |
| Allow. Bearing Cap.(from Geotech. Report) | 2500 | psf |

Loading Data

| | | |
|---|---|---|
| Live Load | 40 | psf |
| Dead Load | 290.17 | psf |
| Tot. Load | 330.17 | psf |

Dome Geometry

| | | |
|---|---|---|
| Max. Separation of Adjacent Domes | 0.25 | inch |
| Dome thickness | 0.24 | inch |
| Inside Diameter | 4.03 | inch |
| Outside Diameter | 4.51 | inch |

Mat. System

| | | |
|---|---|---|
| Mat/Raft | 10 | inch |
| Unit Wt. | 145 | pcf |
| Agg. Base | 16 | inch |
| Unit Wt. | 127 | pcf |

Results

| | | |
|---|---|---|
| Contact dome area | 0.16 | ft^2 |
| Contact soil area | 1.05 | ft^2 |
| % MAT area on SG | 15.41 | % |
| MAT Pressure on soil | 2143 | psf |
| Swell stress by soil | 1541 | psf |
| F.S. against heave | 1.39 | >1.25 |
| Foundation Excavation | 31 | inches |
| | Bearing Pressure is OK | |
| | Downward Pressure is OK | |

| | |
|---|---|
| CLIENT/OWNER | ABCD Development Inc. |
| PROJECT ADDRESS | 1234 Adam Street |
| CITY | Irvine |
| STATE | CA 92600 |
| COUNTRY | USA |
| DESIGNED BY | LAA |

FIG. 14

Pavement Analysis English Units

| | | |
|---|---|---|
| **Soils Data** | | |
| Max. Swell Pressure | 14000 | psf |
| Allow. Bearing Cap. | 3840 | psf |
| CA Bearing Ratio | 4 | % |
| **Loading Data** | | |
| Live Load | 40 | psf |
| Dead Load | 452.67 | psf |
| Tot. Load | 492.67 | psf |
| **Dome Geometry** | | |
| Max. Separation of Adjacent Domes | 0.33 | inch |
| Dome thickness | 0.24 | inch |
| Inside Diameter | 4.03 | inch |
| Outside Diameter | 4.51 | inch |
| **Pavement System** | | |
| 1-Top layer | 8 | inch |
| | 140 | pcf |
| 2 | 16 | inch |
| | 127 | pcf |
| 3 | 12 | inch |
| | 125 | pcf |
| 4-Bottom layer | 6 | inch |
| | 130 | pcf |
| **Results** | | |
| Contact dome area | 0.17 | ft^2 |
| Contact soil area | 1.06 | ft^2 |
| % Pavement area on SG | 16.47 | % |
| Pavement Pressure on soil | 2991 | psf |
| Swell stress by soil | 2306 | psf |
| F.S. against heave | 1.3 | >1.25 |
| Pavement Excavation | 47 | inches |
| | Bearing Pressure is OK | |
| | Downward Pressure is OK | |

| | |
|---|---|
| CLIENT/OWNER | ABCD Development Inc. |
| PROJECT ADDRESS | 1234 Adam Street |
| CITY | Irvine |
| STATE | CA 92600 |
| COUNTRY | USA |
| DESIGNED BY | LAA |

FIG. 15

METHOD AND DEVICE FOR SUPPORTING LIGHTLY LOADED STRUCTURES AND PAVEMENTS ON HIGHLY EXPANSIVE SOILS

The present invention relates to the support of structures in soil, and in particular to supporting lightly loaded structures on highly expansive soil.

BACKGROUND OF THE INVENTION

Expansive soils (also known as swelling soils or active soils) cause foundation and pavement problems worldwide. Expansive soils are found abundantly in both developed and underdeveloped countries. They are abundant in California, Colorado and Texas. Worldwide, they are found in Oman, South Africa, Palestine, Mexico, China and many other nations. They are a particular problem for lightly loaded structures such as one story houses, pavements, warehouses and airport runways. In the United States, expansive soils cause more loss than fire, flood and earthquake damages combined, each year.

Expansive soils are currently identified by Expansion Index Test, Percent Swell Test, Swelling Consolidation Pressure Test or Potential Vertical Rise Analysis. Clays and claystone materials that contain montmorillonite or illite minerals have been known to swell when they absorb moisture and shrink when moisture is extracted.

Distress Caused by Swelling Soils

When lightly loaded structures are built in or on expansive soils, the swelling pressures of the soils far exceeds the downward pressure of the foundation. As a result, the soils heave and the exerted swelling pressures cause the lightly loaded slabs to heave. This in turn causes the partition walls to experience cracks and differential movement. These damages can occur within few years of construction and are expensive to correct. Heavier structures have higher dead load pressure and thus are able to overcome moderate swelling pressures on the footings but still show problems under the slabs.

Prior Art Solutions

Currently foundation design practice varies by region. However, four common foundation designs are employed.

The most popular method involves removing and replacing the foundation soils from 2 feet to 10 feet (0.6 m to 3.0 m) below the ground surface. This is time consuming and expensive. Also suitable soils for replacement may not be readily or locally available.

Another popular method is to pour a concrete slab with steel strands and post tension them after the slab cures. This requires specialty structural engineering firm and knowledgeable geotechnical firm to work together in the design stage. In the construction stage, a specialty contractor is required to stress and test the post tensioned strands. This is not feasible in developing countries and is not cost effective in small size projects.

Common in Australia and Texas is the ribbed beam or waffle slab foundation. This foundation consists of interconnected beams that run both directions of a structure with a 4 to 6 inch (100 mm to 150 mm) reinforced slab. If the swelling pressures are high, the beams are pored on collapsible void boxes to create a 4 to 8 inch (100 mm to 200 mm) void. The intent is to have a void where the swelling soils can move to thus avoiding direct heaving of foundation elements. This is only successful in moderately swelling soils. In addition, it is expensive method due to the required amount of concrete, steel rebar and added labor cost.

FIGS. 16 and 16A show another prior art solution. FIG. 16 shows a split Sonotube® cardboard tube 101 laid down on expansive soil 15. Sonotube® is a registered trademark of the Sonoco Products Company Corporation and commonly refers to a cylindrical form of treated cardboard for forming round columns of concrete. In FIG. 16 cardboard split-tubes 101 have been split lengthwise and laid side by side. Sand has been poured between the gaps. Then concrete slab 103 has been poured over the top of cardboard split-tubes 101 and the sand. Concrete slab 103 is reinforced with rebar 102. The embodiment shown in FIGS. 16-16A has significant problems. Cardboard split-tubes 101 absorb water from the wet concrete slab and disintegrate shortly after the concrete slab is poured. Moreover the contact area of the concrete slab is not reduced significantly by virtue of split-tubes 101. This method had only limited success in soils of low to moderately expansive soils and had no success in soils of high swelling pressures.

FIG. 17 shows another prior art solution. Straw bales 106 (with circular cross section) are laid side by side as shown on the top of expansive soil 15. Pea gravel 107 is poured into the gaps. Concrete slab 105 is then laid on top of pea gravel 107. This embodiment does not significantly reduce the contact area of the concrete slab and had no success in soils with moderate to high swelling pressure.

The most common method of dealing with soils of high to very high swelling pressures is to utilize a pier and grade beam foundations with a structural slab. The drilled piers (bored piles) are usually 12 to 18 inches in diameter (300 to 450 mm) and extend down to 40 feet (12.2 m) into the ground. The piers have to be designed to resist uplift forces and still provide support for the grade beams and structural slabs. This method is the most expensive method and due to technological aspects, it is only available to residents of developed nations.

As can be seen, the problems caused by swelling soils are understood but the available solutions are expensive and cause the home construction cost to increase substantially in developed nations. In developing countries, they make it hard for a poor family to own a distress free home for any extended period of time.

What is needed is a better method and device for supporting lightly loaded structures in highly expansive soils.

SUMMARY OF THE INVENTION

The present invention provides a device and method for supporting lightly loaded structures on highly expansive soils. A plurality of domes is positioned between the lightly loaded structure and the soil. Each of the domes has a convex side and a concave side. The convex side faces upward against the lightly loaded structure and the concave side faces downward against the soil. The concave side provides a void area for expansion of soil. Each dome also has two soil contact ends. The soil contact ends provide a small contact area with the soil so as to increase the pressure exerted by the lightly loaded structure. This overcomes the swelling effects of expanding soil. In a preferred embodiment, the dome is a split PVC pipe (Schedule 40) that is placed with its opening towards the soil. These domes are preferably placed next to each other with a maximum separation of 0.33 inches between them.

BRIEF DESCRIPTION OF THE DRAWINGS

FIG. 14 shows a preferred analysis page where the lightly loaded structure is a foundation slab.

FIG. 15 shows a preferred analysis page where the lightly loaded structure is pavement.

DETAILED DESCRIPTION OF THE PREFERRED EMBODIMENTS

Figure 3:
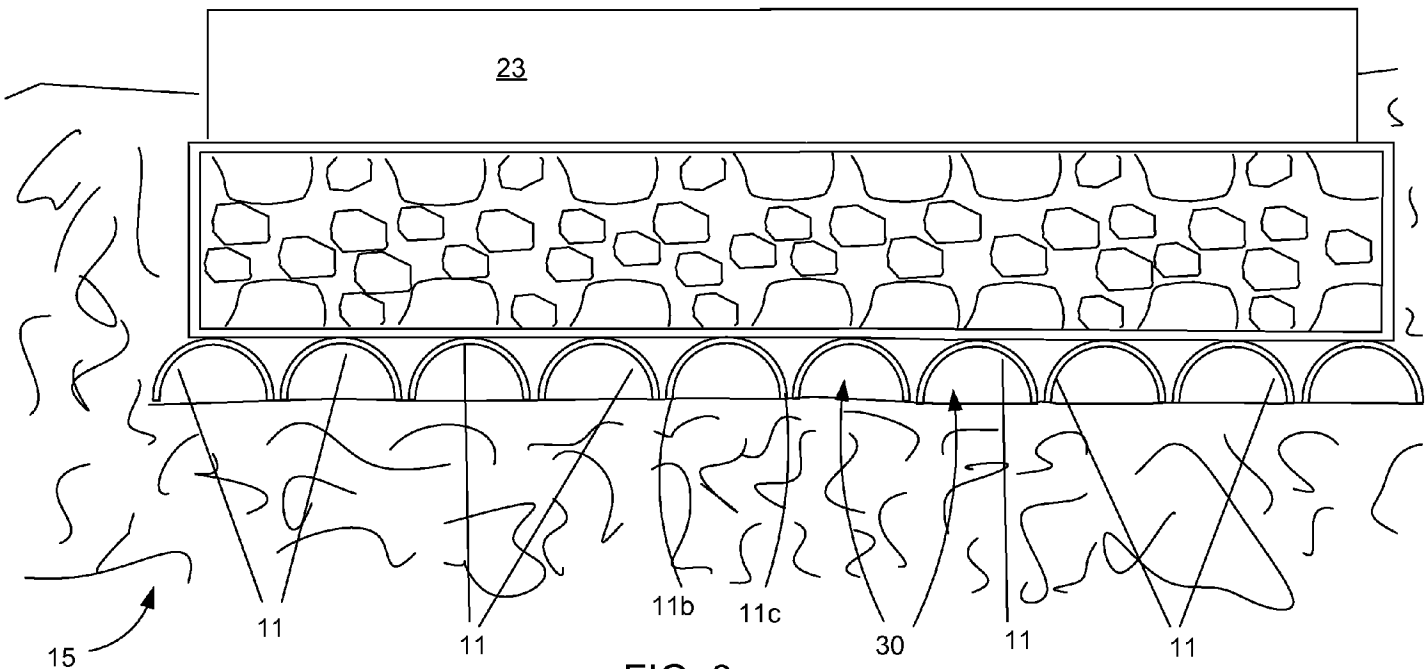
FIG. 3 shows a preferred embodiment of the present invention.

A preferred embodiment of the present invention is shown in FIG. 3. Lightly loaded foundation slab 23 exerts downward force onto expansive soil 15. Domes 11 are positioned between slab 23 and expansive soil 15 with each dome's convex side facing upward against the load and each dome's concave side facing downward against the soil. Each dome 11 creates a void 30 into which soil 15 can expand. Moreover, each dome 11 only has a relatively small area (ends 11*b* and 11*c*) in contact with the soil. Therefore, the pressure exerted by slab 23 at the soil contact area of ends 11*b* and 11*c* is high. As soil 15 expands, it will move into voids 30 created by domes 11. Hence there is only negligible disturbance to slab 23 and it is not damaged as a result of the expansion of soil 15.

Explanation of Operation of Preferred Embodiments

It is known that pressure is equal to a force divided by a contact area. So pressure is directly proportional to the applied force (i.e. higher force leads to higher pressure). It is also known that pressure is inversely proportional to the area supporting the force (i.e. smaller area leads to higher pressure).

In lightly loaded structures, the force, or loads are always small. So in order to get higher foundation pressures to counteract the swelling soils, a smaller area or smaller footing (i.e., ends 11*b* and 11*c*) must be utilized. As stated above each dome 11 only has ends 11*b* and 11*c* in contact with soil 15. The present invention combines the uniform loading of slab 23 and smaller area of dome ends 11*b* and 11*c* to get the high swelling pressure. Therefore, the swelling effects of soil 15 are overcome.

Preferred Domes

Figure 2:
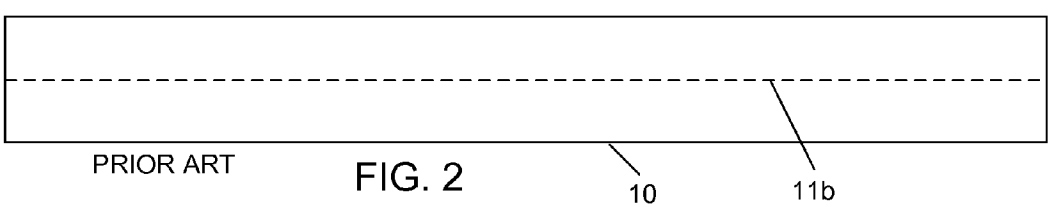
FIG. 2 shows a side view of PVC pipe with a dotted line indicating a preferred cut line.
Figure 1:
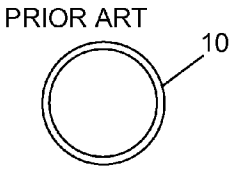
FIG. 1 shows a prior art PVC pipe.

FIG. 1 shows a front view and FIG. 2 shows a side view of 4-inch PVC pipe 10. Preferably, each pipe 10 is cut in half lengthwise along line 10*b* (FIG. 2) to form two extensions each having a semicircular cross section and open on its concave side. Applicant refers to each semicircular extension as a "dome". PVC domes 11 can then easily be laid in an excavation as shown in FIG. 3.

Although it is possible to utilize other materials and methods for fabricating domes 11, it is preferable to cut PVC pipe in half as described. PVC pipe is very inexpensive and is readily available worldwide. Additionally, PVC pipe has additional advantages:

- It is a light weight material
- It has compressive strength similar to concrete
- It is not prone to corrosion and
- It has a contact area of approximately 16% of the structure footprint

A First Preferred Embodiment of the Present Invention

FIGS. 4-9 illustrate a preferred method for utilizing the present invention.

Figure 4:
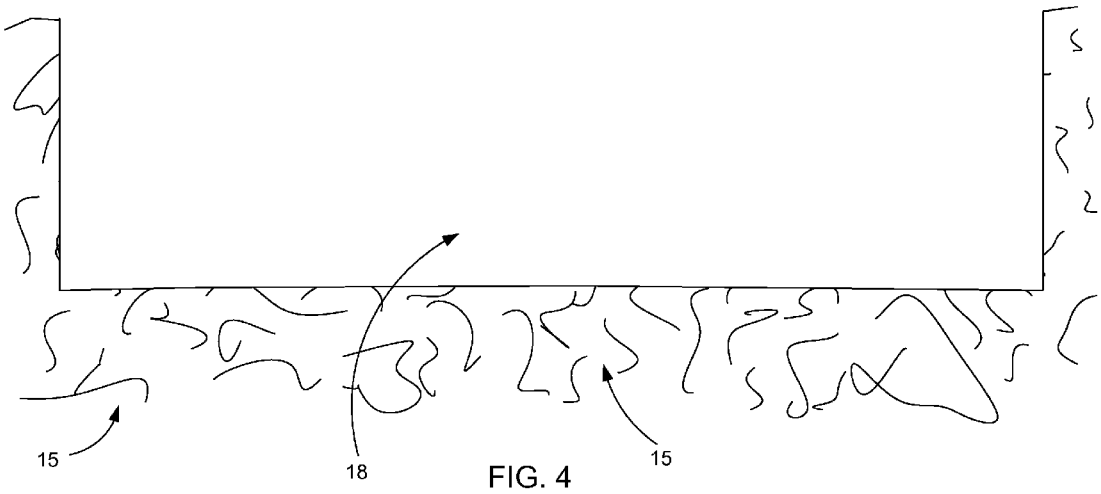
FIGS. 4-9 show a preferred method for utilizing a preferred embodiment of the present invention.

In FIG. 4, a 30.5 inch excavation 18 has been dug into soil 15.

Figure 5:
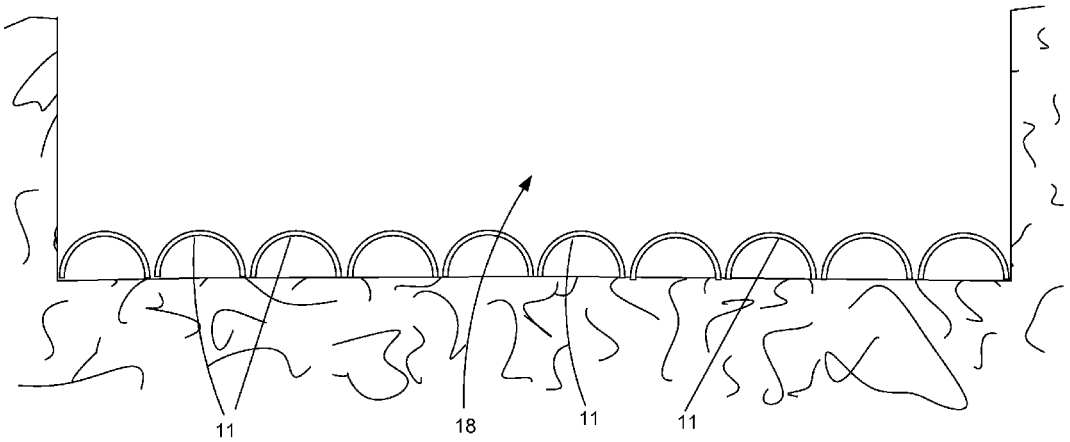

In FIG. 5, domes 11 have been set side-by-side into excavation 18. In a preferred embodiment, domes 11 are approximately 2 inches in height and 4 inches wide and are cut from pre-existing 4-inch PVC pipe (as described above). Each dome 11 is preferably separated by approximately ⅓ inch.

Figure 6:
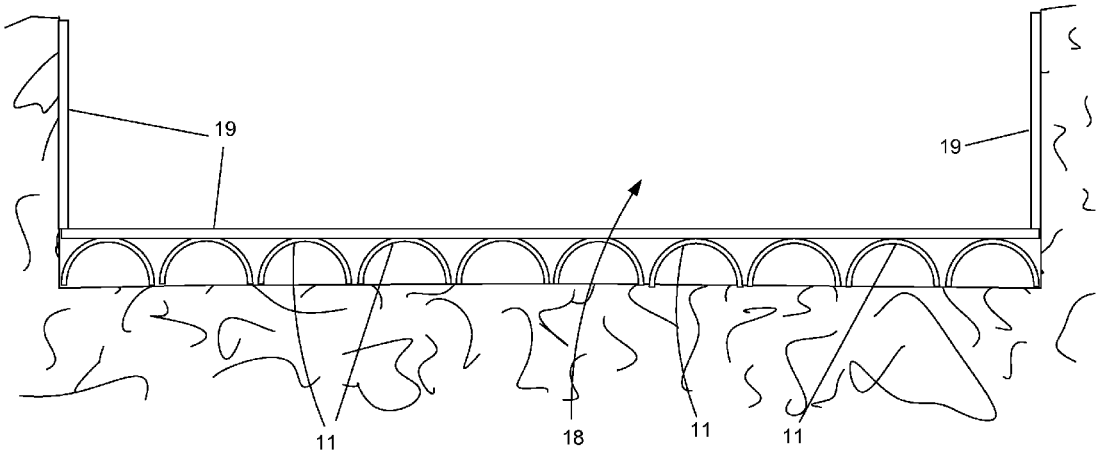

In FIG. 6, 10 Mil vapor barrier 19 has been laid on top of domes 11 as shown. Vapor barrier 19 has also been placed down the sides of excavation 18.

Figure 7:
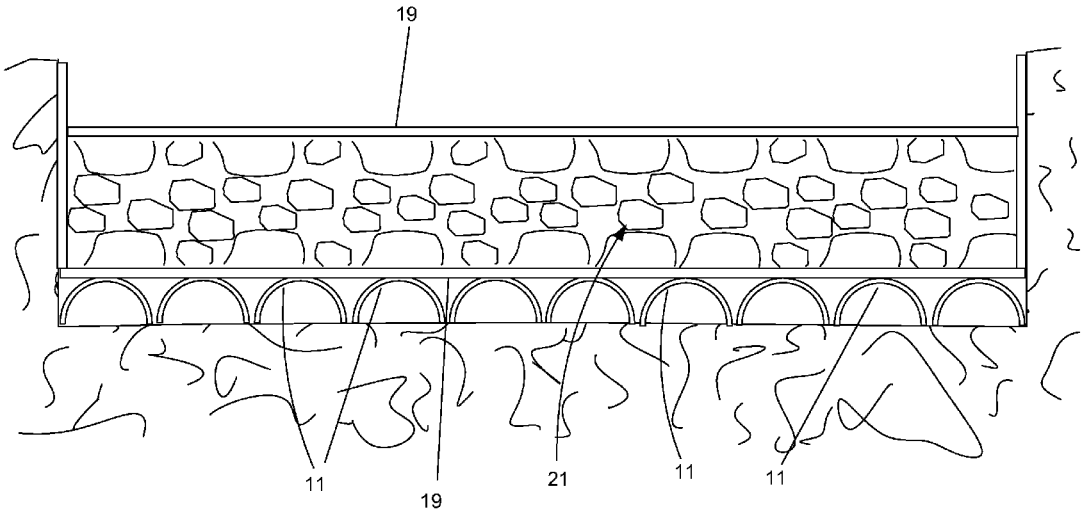

In FIG. 7, road base 21 has been laid on top of vapor barrier 19 that covers domes 11. In a preferred embodiment road base 21 is approximately 16 inches thick and is at 90 percent maximum dry density in accordance with ASTM D1557 Compaction. Another layer of vapor barrier 19 has been laid on top of road base 21.

Figure 8:
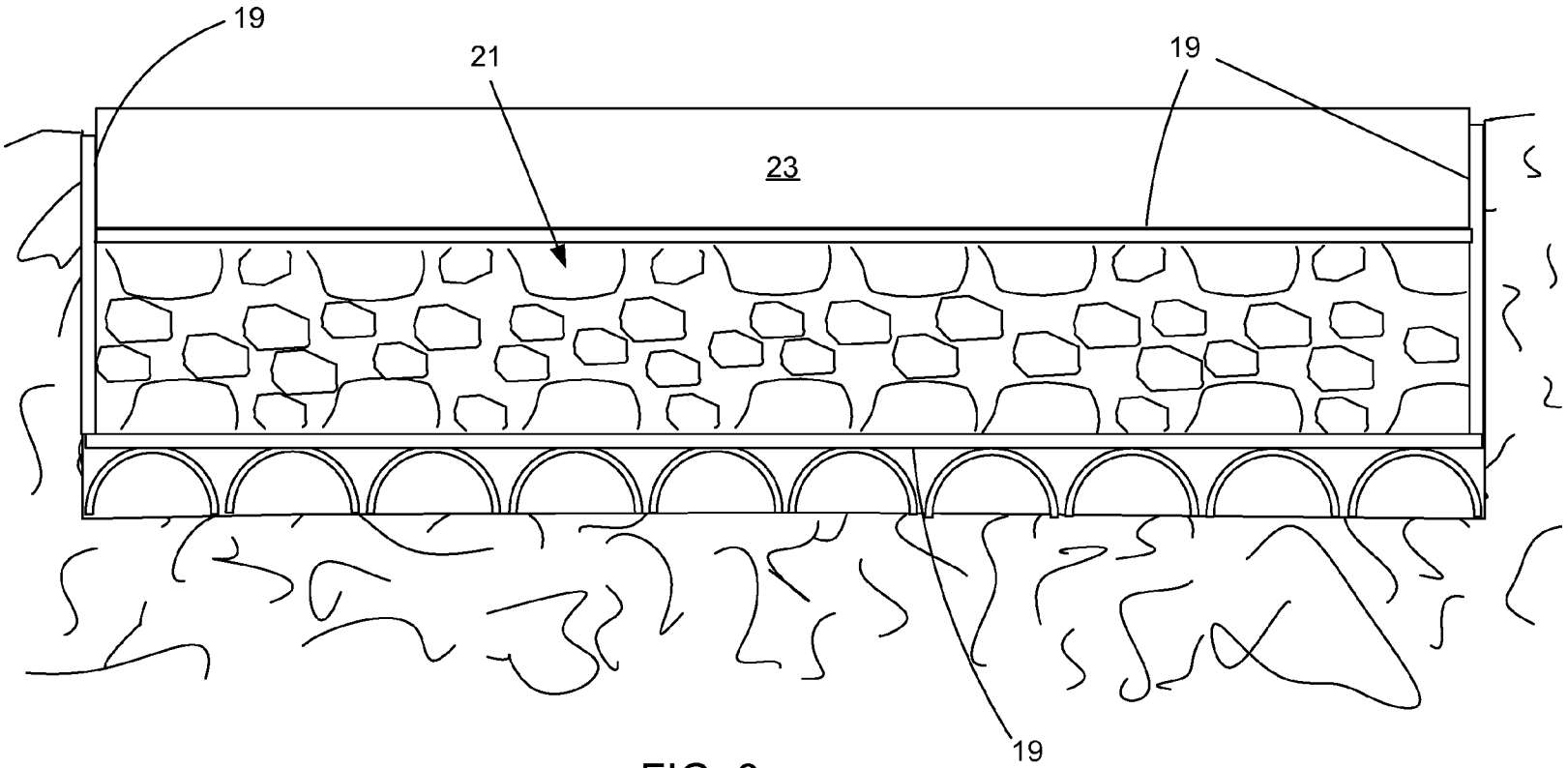

In FIG. 8, concrete foundation slab 23 has been laid on top of road base 21 vapor barrier 19 covering road base 21.

Figure 9:
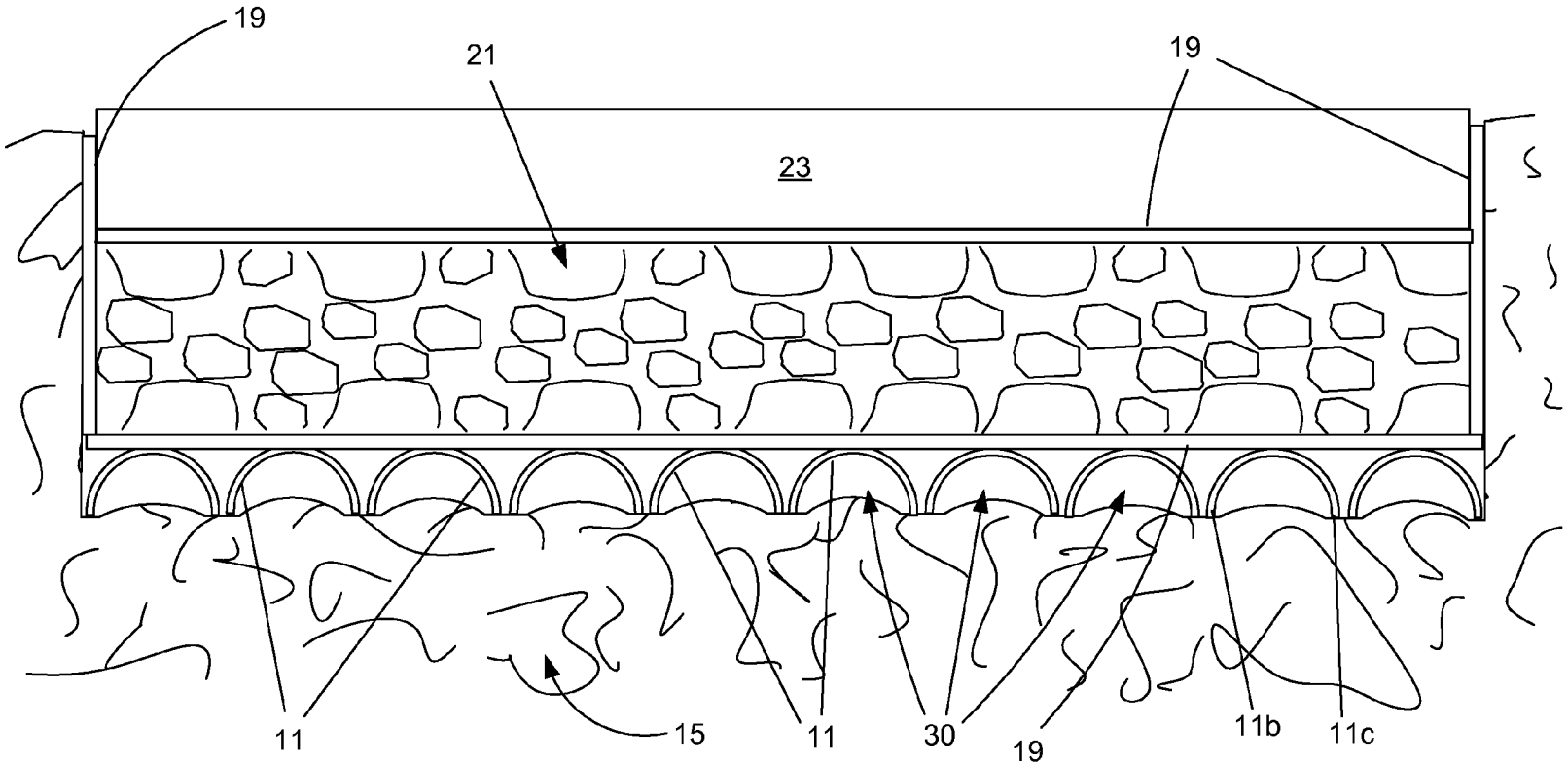

In FIG. 9, soil 15 has expanded. Voids 30 located under domes 11 give soil 15 an area in which to expand. so that the motion transmitted to slab 23 has been greatly diminished. Moreover, each dome 11 only has a relatively small area (ends 11*b* and 11*c*) in contact with the soil. Therefore, the pressure exerted by slab 23 at the soil contact area of ends 11*b* and 11*c* is high. Hence there is only negligible disturbance to slab 23 and it is not damaged as a result of the expansion of soil 15.

Other Preferred Embodiments

Warm Climate

Figure 10:
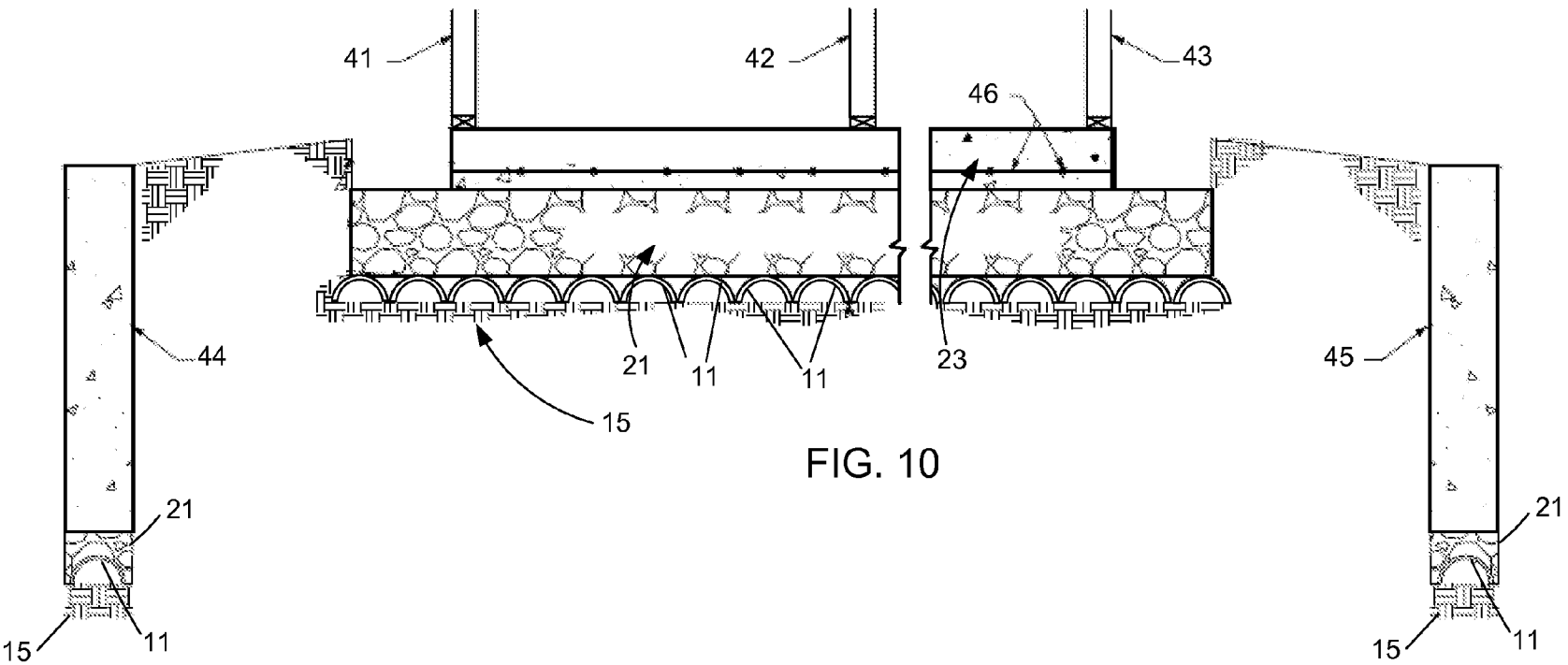
FIG. 10 shows another preferred embodiment of the present invention.

FIG. 10 shows another preferred embodiment of the present invention for utilization in warm climate. Domes 11 have been placed on soil 15 as shown. Road base 21 is surrounded by vapor barrier 19 and rests on domes 11. 10 inch mat foundation slab 23 rests on road base 21. Rebar 46 extends through slab 23 for structural support. Slab 23 supports exterior walls 41 and 43 and interior wall 42. Cutoff walls 44 and 45 are supported by domes 11 and road base 21 as shown. Voids located under domes 11 give soil 15 an area in which to expand so that expansion motion transmitted to slab 23 is greatly diminished. Additionally, the small footing of domes 11 increases the pressure exerted by slab 23. Hence there is only negligible disturbance to slab 23 and it is not damaged as a result of the expansion of soil 15.

Cold Climate

Figure 11:
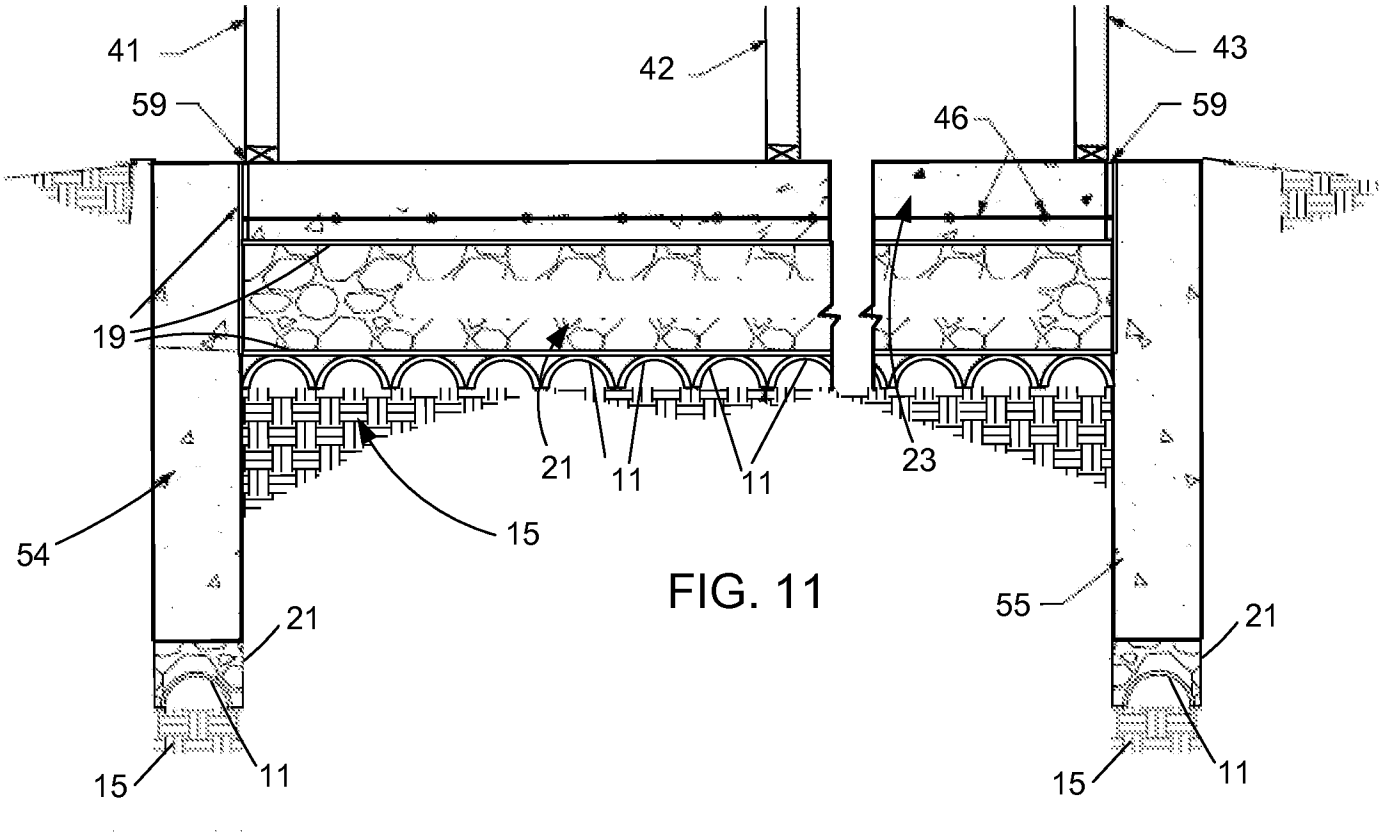
FIG. 11 shows another preferred embodiment of the present invention.

FIG. 11 shows another preferred embodiment of the present invention for utilization in cold climate. Domes 11 have been placed on soil 15 as shown. Road base 21 rests on domes 11 and is surrounded by vapor barrier 19. 10 inch mat foundation slab 23 rests on road base 21. Rebar 46 extends through slab 23 for structural support. Slab 23 supports exterior walls 41 and 43 and interior wall 42. ½-inch slip joints 59 are positioned as shown between slab 23 and cutoff/frost walls 54 and 55. Cutoff walls 54 and 55 are supported by domes 11 and road base 21 as shown. Voids located under domes 11 give soil 15 an area in which to expand so that expansion motion transmitted to slab 23 is greatly diminished. Additionally, the small footing of domes 11 increases the pressure exerted by slab 23. Hence there is only negligible disturbance to slab 23 and it is not damaged as a result of the expansion of soil 15.

Basements

Figure 12:
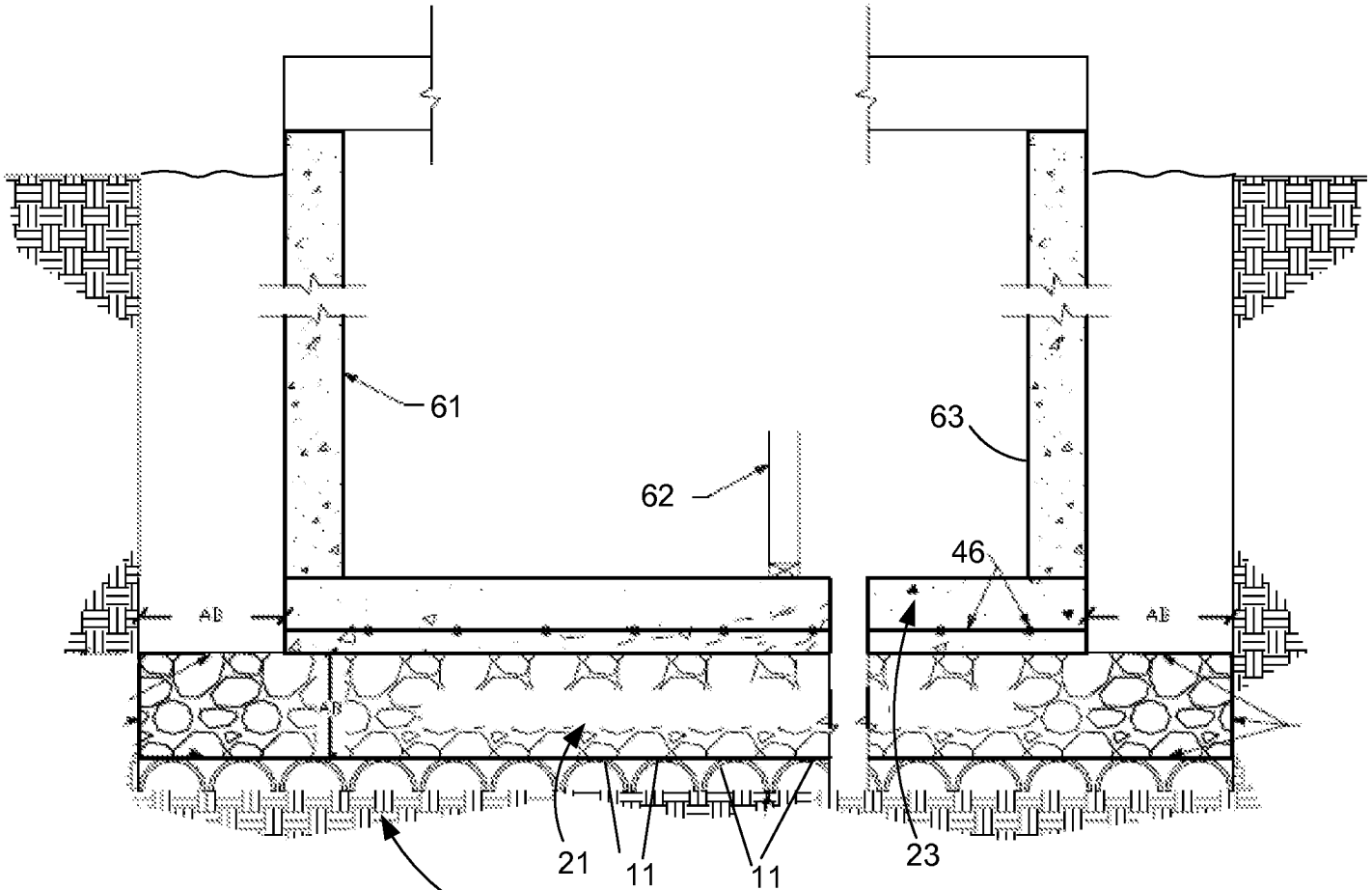
FIG. 12 shows another preferred embodiment of the present invention.

FIG. 12 shows another preferred embodiment of the present invention for utilization for a structure having a basement. Domes 11 have been placed on soil 15 as shown. Road base 21 rests on domes 11 and is surrounded by vapor barrier 19. 10 inch mat foundation slab 23 rests on road base 21. Rebar 46 extends through slab 23 for structural support. Slab 23 supports basement walls 61 and 63 and interior wall 62. Voids located under domes 11 give soil 15 an area in which to expand so that expansion motion transmitted to slab 23 is greatly diminished. Additionally, the small footing of domes 11 increases the pressure exerted by slab 23. Hence there is only negligible disturbance to slab 23 and it is not damaged as a result of the expansion of soil 15.

Concrete Pavement

Figure 13:
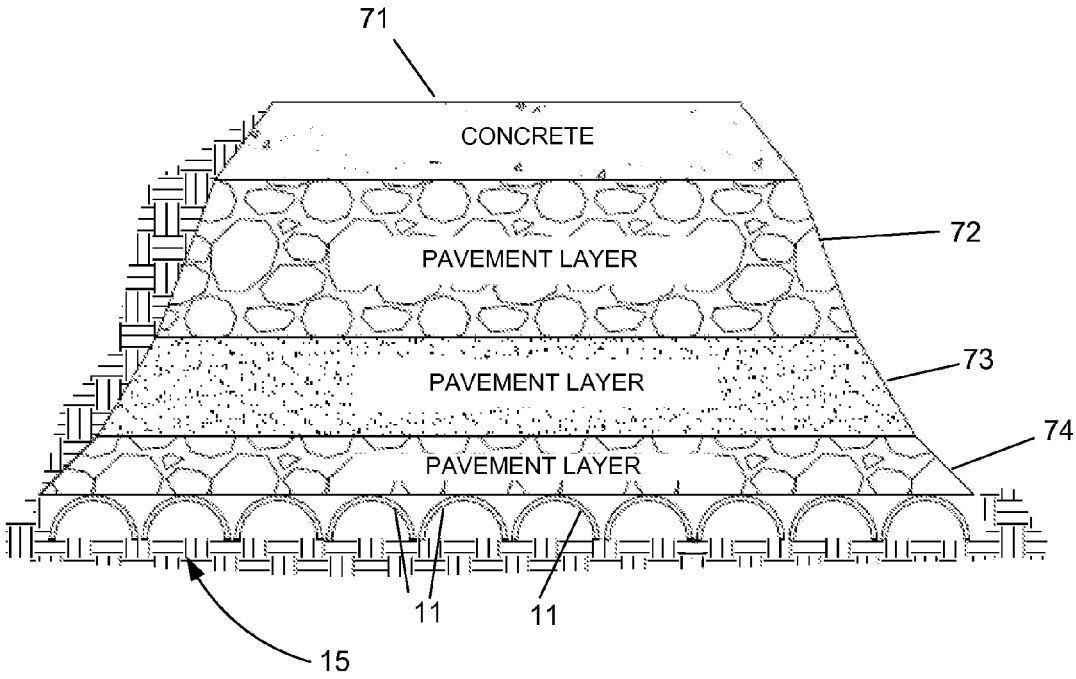
FIG. 13 shows another preferred embodiment of the present invention.
Figure 16:
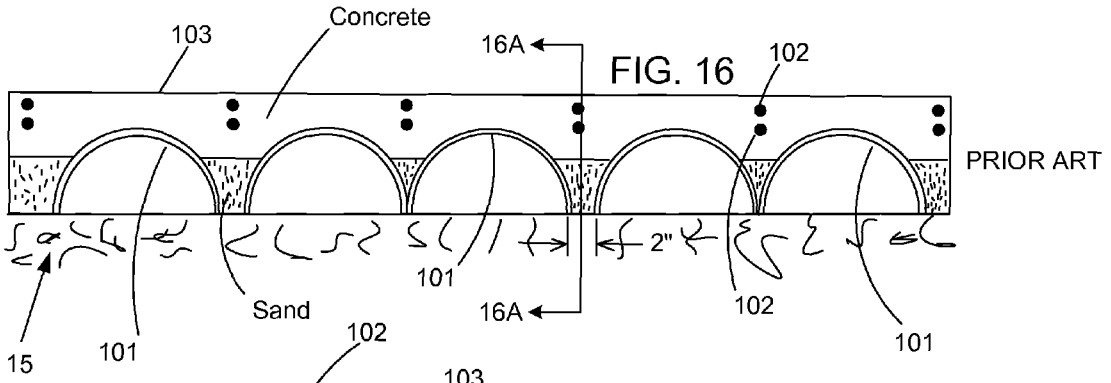
FIGS. 16 and 16A show a prior art device.
Figure 16A:
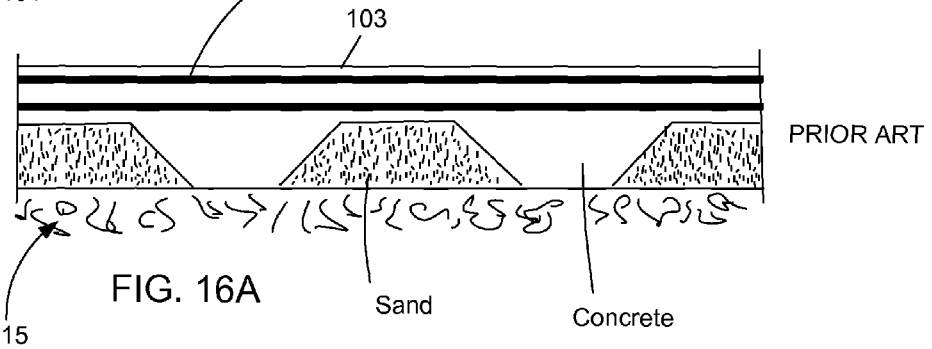
Figure 17:
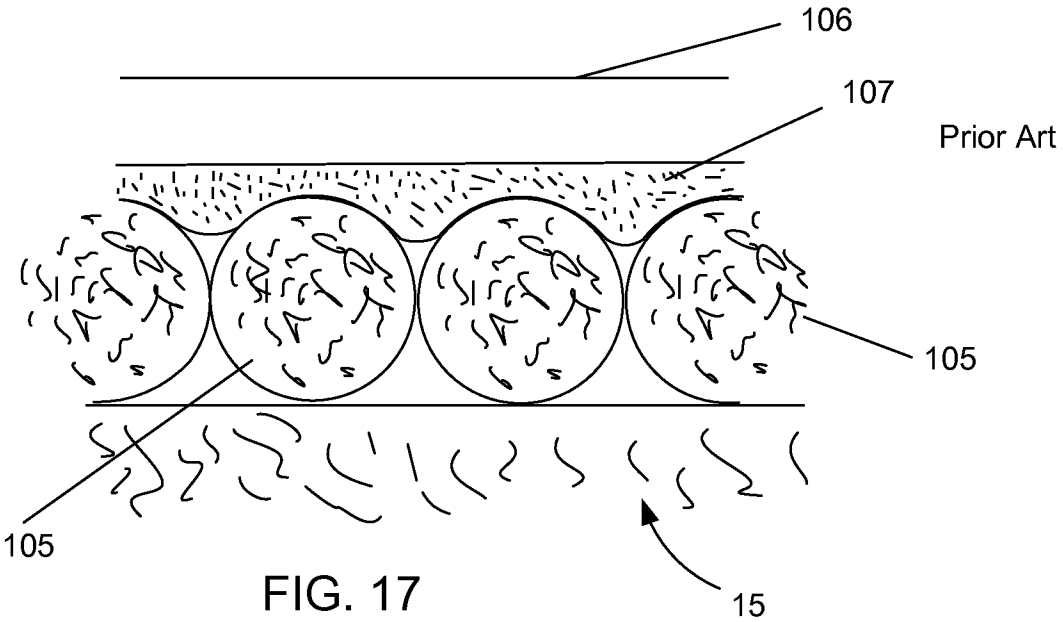
FIG. 17 shows another prior art device.

FIG. 13 shows another preferred embodiment of the present invention for utilization for concrete pavement 71. Domes 11 have been placed on soil 15 as shown. Pavement layers 72-74 are laid on top of domes 11. Concrete pavement 71 rests on pavement layer 72 as shown. Voids located under domes 11 give soil 15 an area in which to expand so that expansion motion transmitted to pavement 71 is greatly diminished. Additionally, the small footing of domes 11 increases the pressure exerted by pavement 71. Hence there is only negligible disturbance to slab 23 and it is not damaged as a result of the expansion of soil 15.

Other Usages for Dome Design

It should be recognized that domes 11 can be utilized to support a large variety of structures. For example, domes 11 can be to support light buildings, pavements, highways, taxiways/aprons/runway, canals, warehouses and other lightly loaded structures.

Software Verification

In a preferred embodiment an engineer utilizes a computer appropriately programmed to verify design and load parameters prior to beginning construction. Example calculations are shown on spreadsheets shown in FIGS. 14 and 15.

Steps for Preparing and Verifying a Foundation Design

The following are preferred steps for preparing and verifying a foundation design (FIG. 14).

Steps to obtain foundation input parameters:

1. Obtain allowable soil bearing capacity from the geotechnical engineer of record.
2. Obtain swelling pressure from the geotechnical engineer of record as stated in ASTM D 4546-08 (Standard Test Method for One Dimensional Swell). It is suggested to multiply this swelling pressure by 1.33 to account for soil heterogeneity.

Steps to obtaining foundation design (entered into provided software):

1. enter the allowable bearing capacity-from the geotechnical report
2. enter the swelling pressure-fro the geotechnical report
3. choose minimum Mat thickness of 10 inches (250 mm)
4. choose Aggregate Base or Slurry thickness and unit weight which produces Factor of Safety (F.S.) against heave is greater than 1.25
5. submit above information to the structural engineer of record to complete foundation design

Steps for Preparing and Verifying a Pavement Design

The following are preferred steps for preparing and verifying a pavement design (FIG. 15).

Steps to obtain pavement design parameters:

1. Obtain California Bearing Ratio (CBR) value from the pavement or geotechnical engineer of record. The provided software computes allowable soil bearing capacity from CBR value entered. (ASTM D 1883-07 or later edition.)
2. Obtain swelling pressure from the geotechnical engineer of record as stated in ASTM D 4546-08 (Standard Test Method for One Dimensional Swell). It is suggested to multiply this swelling pressure by 1.33 to account for soil heterogeneity.

Steps to obtaining pavement thickness parameters:

1. enter the CBR value form above
2. enter the swelling pressure from above
3. enter the pavement system layers and their unit weights based on pavement design principles. If F.S. against heave is greater than 1.25 adopt design.
4. If F.S. against heave is less than 1.25, increase one or more of the pavement layer thicknesses until F.S. against heave is greater than 1.25 and then adopt this design.
5. Submit the above information to the pavement engineer of record to complete pavement design process.

In foundation and pavement design, cut off wall and drainage control measures are often incorporated into the design.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention

What is claimed is:

1. A device for supporting a lightly loaded structure, including a concrete slab, on highly expansive soils, said device comprising:

A) a plurality of elongated polyvinyl chloride (PVC) domes, each of the plurality of elongated PVC domes comprised of one-half of a 4-inch PVC pipe cut in half lengthwise, defining a semicircular cross section, a convex side and a concave side, and positioned in an evacuation in the highly expansive soil:

1) side-by side, 2) parallel to each other and 3) separated from each other by no more than 0.33 inch, with the plurality of elongated PVC domes being positioned between the concrete slab of the lightly loaded structure and the highly expansive soil with the convex side positioned upward toward the lightly loaded structure and the concave side positioned downward toward the highly expansive soil, B) a layer of road base material located between the plurality of elongated PVC domes and the concrete slab, C) vapor barriers positioned:

1) vertically between the road base material the highly expansive soil, 2) horizontally between the plurality of elongated PVC domes and the road base material, and 3 positioned horizontally between the road base material and the concrete slab;

wherein exerted pressure of the highly expansive soil against the lightly loaded structure is minimized.

2. The device as in claim 1, wherein said lightly loaded structure is a house.

3. The device as in claim 1, wherein said lightly loaded structure is a building.

4. The device as in claim 1, wherein said lightly loaded structure is a highway.

5. A method for supporting a lightly loaded structure including a concrete slab on highly expansive soils, said method comprising the steps of:

A) excavating a region of the highly expansive soil

B) placing within the evacuated region, 1) a plurality of elongated polyvinyl chloride (PVC) domes, each of the plurality of elongated PVC domes comprised of one-half of a 4-inch PVC pipe cut in half lengthwise, defining a semicircular cross section, a convex side and a concave side, and positioned:

a) side-by side, b) parallel to each other and c) separated from each other by no more than 0.33 inch, between the concrete slab of the lightly loaded structure and the highly expansive soil with the convex side positioned upward toward the lightly loaded structure and the concave side positioned downward toward the highly expansive soil, 2) a layer of road base material located between the plurality of elongated PVC domes and the concrete slab, 3) vapor barriers positioned:

a) vertically between the road base material the highly expansive soil, b) horizontally between the plurality of elongated PVC domes and the road base material, and c) positioned horizontally between the road base material and the concrete slab;

wherein exerted pressure of the highly expansive soil against the lightly loaded structure is minimized.

* * * * *